US005934389A

United States Patent [19]

Ramsey et al.

[11] Patent Number: 5,934,389

[45] Date of Patent: Aug. 10, 1999

[54] METHOD FOR INCREASING HYDRAULIC EFFICIENCY OF DRILLING

[76] Inventors: Mark S. Ramsey, 6130 Inway Dr., Spring, Tex. 77389; William C. Morris, Jr., 23407 Cranberry Trail, Spring, Tex. 77373

[21] Appl. No.: 08/424,128

[22] Filed: Apr. 19, 1995

Related U.S. Application Data

[63] Continuation of application No. 08/087,667, Jul. 6, 1993, abandoned.

[51] Int. Cl.[6] ..... E21B 7/00; E21B 45/00

[52] U.S. Cl. ..... 175/57; 175/40; 175/340

[58] Field of Search ..... 175/393, 340, 175/339, 57, 317, 40

[56] References Cited

U.S. PATENT DOCUMENTS

| | | | |
|---|---|---|---|
| 2,950,090 | 8/1960 | Swart | 175/340 |
| 2,987,130 | 6/1961 | McIntyre | 175/318 |
| 3,087,558 | 4/1963 | Dougherty, Jr. | 175/393 X |
| 3,189,107 | 6/1965 | Galle | 175/393 |
| 3,213,949 | 10/1965 | Kistler, Jr. . | |
| 3,261,413 | 7/1966 | Kistler, Jr. | 175/317 |
| 3,645,331 | 2/1972 | Maurer et al. | 175/393 X |
| 3,645,346 | 2/1972 | Miller et al. | 175/340 X |
| 4,114,705 | 9/1978 | Milan | 175/340 |
| 4,372,402 | 2/1983 | Trevino, Jr. | 175/318 |
| 4,942,930 | 7/1990 | Millsapps, Jr. | 175/228 |
| 5,020,724 | 6/1991 | Kiyono et al. | 239/102.2 |

FOREIGN PATENT DOCUMENTS

| | | | |
|---|---|---|---|
| 861537 | 9/1981 | Russian Federation | 175/393 |

OTHER PUBLICATIONS

J.A. Short, *Drilling and Casing Operations*, Tulsa, Oklahoma, PennWell Publishing Company, pp. 241–248, TN871.25537.

*Primary Examiner*—Hoang C. Dang
*Attorney, Agent, or Firm*—Baker & Botts, L.L.P.

[57] ABSTRACT

An apparatus and a method for adjusting the total flow area of a drilling bit concurrently with drilling which includes a bit having a plurality of nozzles, each nozzle having a flow area and the bit having a total flow area, with at least one nozzle which is initially open and having a first flow area and at least one other nozzle which is initially closed and having a second flow area including a closure means for maintaining the nozzle in an initially closed state below a pre-selected differential pressure across the bit.

2 Claims, 1 Drawing Sheet

FIG. 1
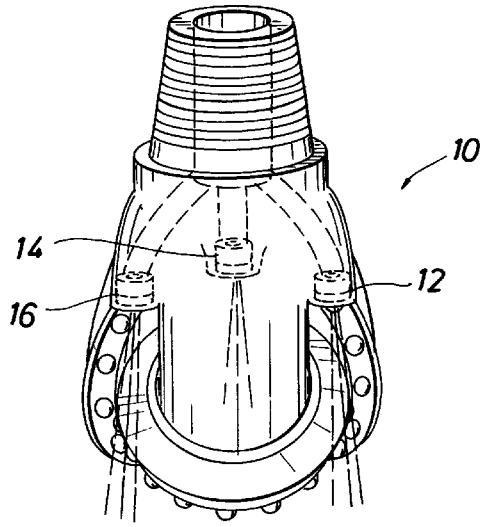
FIG. 4
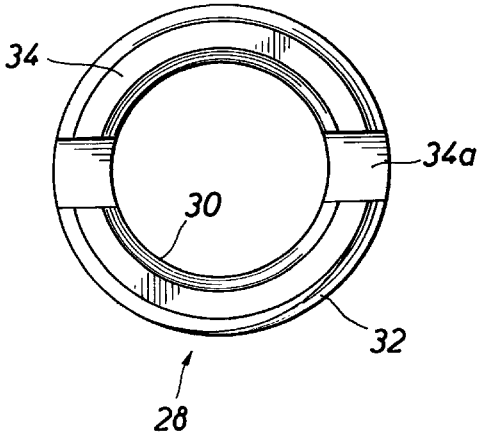
FIG. 2
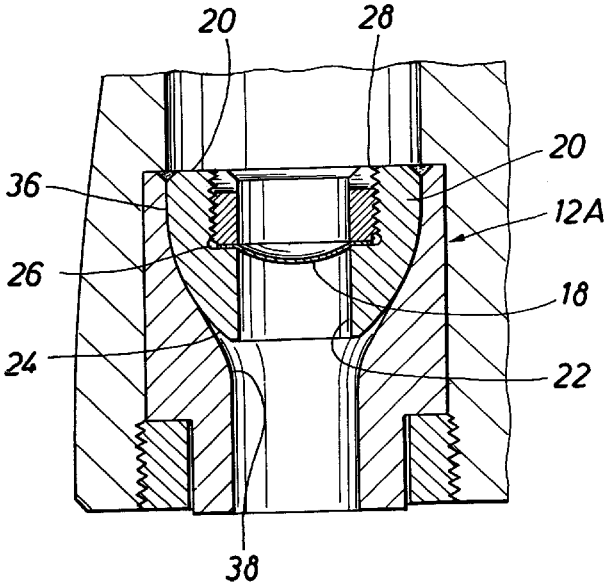
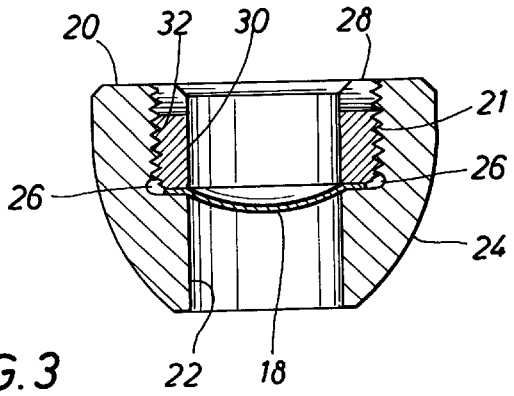
FIG. 3

METHOD FOR INCREASING HYDRAULIC EFFICIENCY OF DRILLING

This is a continuation of application Ser. No. 08/087,667 filed on Jul. 6, 1993, now abandoned.

FIELD OF THE INVENTION

The present invention generally involves drilling bits, and more particularly the invention is directed to a method and an apparatus that allows an adjustment in the total flow area of the bit concurrently with drilling.

BACKGROUND OF THE INVENTION

In known drilling methods, the rock is destroyed by rolling cutters on a drill bit or by stationary cutting surfaces such as in drag bits or diamond bits. This mechanical destruction of the rock produces debris which has to be removed as it is formed so that the bit is constantly operating on new rock.

To remove the debris being formed during drilling, a drilling fluid is circulated through the well as it is drilled. Bits incorporate nozzles which direct the drilling fluid (or mud) to the hole-bottom. A typical rock drilling bit has three rotating cutters with three nozzles arranged around the cutters. A fourth centrally placed nozzle is also available on some drill bits. Other bits can have as few as two or more than four nozzles. The drilling fluid is in constant circulation while drilling and has several basic functions. The circulating drilling fluid maintains higher pressure in the wellbore than in the surrounding rock to prevent formation fluid(s) from entering the wellbore. The circulating fluid also cools the drill bit, cleans the cutters, and removes the rock debris from the bottom of the hole.

The hydraulic system of a drilling well controls the speed and pressure of the circulating mud and an optimized hydraulic system can improve the drilling rate, reduce equipment inefficiencies and lower drilling costs. The hydraulic system is controlled by four different factors. The first is the surface pumps which circulate the drilling fluid down the pipe, through the bit nozzles, back up the annulus, and back down the pipe. The second is the loss in pressure caused by friction as the drilling fluid goes down the pipe. A third factor is the pressure loss at the drill bit which occurs when the drilling fluid leaves the drill bit nozzles and the fourth is the pressure loss in the annulus which occurs as the drilling fluid is circulated back up the annulus to the surface to be recirculated back down the pipe. A comprehensive discussion of well hydraulics can be found in J. S. Short, *Drilling and Casing Operations,* Tulsa, Okla., PennWell Publishing Company, p. 241–248, TN871.2S537, and numerous other drilling publications.

The pressure loss that occurs at the drill bit, is largely dependent upon the diameter of the nozzles placed in the drill bit prior to drilling for a given mud weight and mud flow rate. Thus, the larger the diameter of nozzles used, the less of a pressure drop at the bit, which results in a decrease in fluid velocity as the mud exits the nozzles. Conversely, the smaller the diameter, the greater the pressure drop at the bit, which results in an increase in fluid velocity as the mud exits the nozzles.

The diameters of the nozzles determine the total flow area (TFA) of a bit. The TFA of a bit is equal to the sum of the flow areas of the nozzles in the bit. The appropriate total flow area for any given drill bit is determined by the depth of the well, the drilling assembly used, the drilling fluid characteristics, and the hydraulic system's flow rate.

Currently, when a drill bit TFA needs to be increased or decreased, drilling is stopped, the drill bit is removed from the well and the nozzles are replaced.

When drilling is stopped to remove the drill bit from the well, the average drilling rate slows down and drilling costs increase or the well is drilled with non-optimum hydraulics. Thus, it would be an advantage to be able to optimize a drilling well's hydraulic system by having the ability to change the drill bit TFA concurrently with drilling without having to remove the drill bit from the well.

SUMMARY OF THE INVENTION

The present invention is directed to an apparatus and a method for changing the total flow area of a drill bit concurrently with drilling. The drill bit has a plurality of nozzles with each nozzle having a flow area and the bit having a total flow area. The bit has at least one nozzle which is initially open and at least one nozzle which is initially closed by means of a rupture disc that will open at pre-selected differential pressures. In one embodiment, the rupture disc has a threshold that is above the differential pressure level present when at least one of the nozzles is normally open and below the pressure level present when at least one of the normally open nozzles is closed. When the rupture disc opens fluid flows through the nozzle causing a change in the drill bit TFA which results in an adjustment in the pressure loss at the drill bit.

The rupture disc fits in a sleeve that is shaped to fit within a drill bit nozzle and is retained within the sleeve by a locking retaining ring. In a preferred embodiment, the sleeve and the retaining ring are formed of a mild tool steel or other material that is rapidly eroded by the flow of drilling fluid through the nozzle after the flow blocking disc ruptures. The erodibility of the mild tool steel allows the complete elimination of the sleeve and retaining ring after the rupture disc has opened.

A method is provided to adjust the total flow area of a drilling bit concurrently with drilling by mounting a rupture disc or pressure activated valve on at least one of the nozzles of a drill bit which has a plurality of nozzles, with the rupture disc or valve being adapted to open at a pre-selected differential pressure. Closing at least one of the open nozzles or increasing pump pressure will cause an increase in the differential pressure, the increase causing the rupture disc to open allowing fluid to flow through the nozzle which results in an adjustment in the total flow area of the bit. Similarly, any other method of increasing the differential pressure will also permit adjustment of the total flow area of the bit.

BRIEF DESCRIPTION OF THE DRAWINGS

A better understanding of the invention can be obtained when the detailed description of the exemplary embodiments set forth below are reviewed in conjunction with the accompanying drawings, in which:

FIG. 1 is a drawing of a typical drilling bit containing three nozzles;

FIG. 2 is a cross-sectional side view of an embodiment the present invention;

FIG. 3 is a cross-sectional side view of a portion of an embodiment of the invention as shown in FIG. 2;

FIG. 4 is a top plan view of a retainer ring of the present invention.

DETAILED DESCRIPTION OF PREFERRED EMBODIMENT

The present invention includes an apparatus and method which allows an adjustment in the total flow area of the bit concurrently with drilling. A typical drilling bit 10, illustrated in FIG. 1, has three rotating cutters with three nozzles 12, 14 and 16 arranged around the cutters. In current drilling bits all three of the nozzles 12, 14 and 16 are normally open or are permanently blanked or closed allowing drilling fluid or mud to flow through the open nozzles to the hole-bottom. In the present invention, one or more of the nozzles 12,14,16 of the drilling bit 10, contains a rupture disc 18 (not shown in FIG. 1) or a pressure activated valve (not shown) which will allow the nozzle to be maintained in a normally closed state as a blank nozzle until the rupture disc 18 is opened by a pressure differential across the bit. Alternatively, a normally closed valve which opens at a pre-selected differential pressure may be used.

FIG. 2 illustrates a blank nozzle 12A containing the rupture disc 18 in a sleeve 20 with a retaining ring 28 secured to an inner surface 38 of the nozzle 12A. The rupture disc 18 is designed to open at a specific differential pressure range. Such rupture discs are well known in the industry and are available, for example, from Autoclave Engineers of Houston, Tex. When the pre-selected differential pressure range is reached, the opening of the rupture disc 18 will cause the blank nozzle 12A to become a working part of the drill bit 10 with mud flowing through the nozzle 12A.

As shown in FIGS. 2 and 3, the rupture disc 18 is maintained in a circular sleeve 20 with a retaining ring 28. The sleeve 20 has an inner surface 22 and an outer surface 24 and in a preferred embodiment is formed of mild tool steel which will erode away with fluid circulation so as to eliminate the sleeve 20 from an opened nozzle. A groove 26 is in the inner surface 22 of the sleeve 20 for holding the rupture disc 18 in place within the sleeve 20. The sleeve 20 also has threading 21 along a portion of its inner surface 22 adapted to thread with the retainer ring 28.

The retaining ring 28, as illustrated in FIG. 4, has an inner surface 30 and a threaded outer surface 32 and in a preferred embodiment is formed of mild tool steel which will also erode away with fluid circulation so as to eliminate the ring 28 from an opened nozzle. The surface 34 of the retaining ring 28 can include notches 34*a* or a similar female cavity for engaging with an allen wrench (not shown) or other torque applying device to properly secure the retaining ring 28 in the sleeve 20 of FIGS. 2 and 3.

The sleeve 20 can be fastened to the inner surface 38 of the nozzle 12A in any manner. In a preferred embodiment, the outer surface 24 of the ring 20 is brazed to the inner surface 38 of the nozzle 12A.

In operation the blank or closed nozzle 12A is installed in the drill bit 10 by replacing a nozzle, such as nozzle 12 prior to drilling. The closed nozzle 12A may or may not have a different nozzle size from the nozzle being replaced depending upon the anticipated changes in drilling conditions. If during drilling, the total flow area of the bit needs to be changed in order to optimize the well's hydraulic system, the rate of flow of drilling fluid through the bit can be temporarily increased to cause the rupture disc 18 to open. The drilling fluid or mud flowing through the previously closed nozzle 12A causes a change in the total flow area of the bit which decreases the pressure loss at the drilling bit.

Alternatively, a ball can be dropped into the drill pipe to plug one of the drill bit nozzles 14,16. The dropping of balls to plug nozzles is well know in the art. The blocked nozzle 14 or 16 will create an increase in the hydraulic system's pressure which will cause the rupture disc 18 to open allowing mud to flow through the previously closed nozzle 12A.

There are several drilling situations in which the present invention can be beneficial. The first situation occurs when drilling fluid density changes. When the drilling fluid density is changed, a well's hydraulic efficiency is drastically decreased since hydraulics is optimized by having the appropriate bit TFA for one relative drilling fluid density. Hydraulic and cost efficiency are lost if the bit TFA cannot be changed also. For example, when drilling fluid density is changed from 9 pounds per gallon (ppg) to 13 ppg, the optimized bit TFA for the 13 ppg fluid is much greater than for the 9 ppg fluid for a given flow rate. This increase in fluid density will cause the drill bit pressure loss to increase. The increase in bit pressure loss creates an increase in the hydraulic system's pressure which will increase the fluid velocity of the mud as it exits the nozzle. If a drill bit 10 having the closed nozzle 12A is used, this bit pressure loss increase will open the rupture disc 18 and return the system's pressure to normal and allow drilling to continue with the optimized bit TFA for the 13 ppg fluid. In a reverse situation, when the fluid changes density from a higher ppg to a lower ppg, the present invention can also be utilized by using a drill bit with a closed nozzle 12A having a flow area more appropriate for the lower density fluid when one of the previous nozzles having a flow area appropriate for the higher density fluid is plugged by dropping a ball.

The present invention is also beneficial when a lengthy bit run is in progress. Drill bit hydraulics is also a function of depth, and the associated hydraulic drill pipe frictional loss is proportional to the depth of the well for a given flow rate. Drill bit hydraulics can be optimized when drilling a short bit run, but cannot be completely optimized for long bit runs. For example, when drilling a long bit run, the optimized drill bit TFA in the shallower section may be greater than the optimized bit TFA in the deeper section. If a drill bit 10 is used, which has a closed nozzle 12A with a smaller nozzle flow area than the area of the open nozzles, the optimization for a long bit run will improve by allowing the bit TFA to be changed while drilling. The hydraulic system's pressure can be temporarily increased at the correct depth by dropping a ball into the drill pipe to plug one nozzle of the drill bit. The change in differential pressure will cause the rupture disc 18 in the closed nozzle 12A to open and fluid will flow through the smaller nozzle area, allowing a lower optimized bit TFA to be realized.

Another situation in which the present invention is advantageous is when drill bit nozzles become plugged while drilling. If a drill bit drills in a formation that is very unconsolidated and clay enriched (gumbo) the drill bit nozzles tend to plug with the gumbo. When this occurs, a downhole attempt is made to unplug the nozzles, but the bit must usually be removed from the well to unplug the debris. If a drill bit containing a closed nozzle 12A is used, a plugged nozzle situation will cause the rupture disc 18 to open due to excess hydraulic pressure. Fluid will flow through the previously closed nozzle 12A returning the hydraulic system to an optimized condition and drilling can continue uninterrupted.

Another example of when the invention may be used as a safety valve is when nozzles get plugged with drilling fluid additives. When drilling wells that tend to lose drilling fluid into weak, permeable formations, lost circulation material (LCM), is commonly added to the mud to help control and prevent fluid losses. Some LCM particles are large enough to plug the nozzles. Traditional drilling practice for this type of well has been to use large diameter nozzles that are less likely to become plugged. This usually means that the hydraulics are not optimized for the well. With the present invention, a drill bit can be used with optimum nozzle sizes and a large diameter closed nozzle 12A can be added for activation in case the optimized nozzles are plugged by the LCM.

The present invention can also be used in hydraulics experiments. Previously, drill bit TFA has been a fixed value in experiments since it could not be altered during a test. However, since a drill bit containing a closed nozzle 12A would allow the bit TFA to be increased or decreased during testing by methods mentioned above, it could be used as an experimental variable, allowing data interpretation and deduction to be attributed to specific changes in the bit TFA and associated parameters. For example, in an experiment to see if the hydraulic system's flow rate has an effect on the drilling penetration rate for a given a certain mud weight, the present invention can be utilized to allow a test to be done at two different flow rates, while keeping the system's pressure constant, which is the needed control. The test would start at a lower flow rate and specific pressure. When the required data has been collected, the flow rate can be increased, causing a temporary increase in the system's pressure until the rupture disc 18 in the closed nozzle 12A opens. When the rupture disc 18 opens, the pressure will return to the previous level and the higher flow rate test can be conducted since the bit TFA has been increased.

The subject invention was used in a field test. A drill bit, containing three open nozzles with nozzle diameter sizes of 12, 13, 13 (for example, a 13 size nozzle has a diameter of 3/32 ") and a closed size 18 nozzle containing a rupture disc rated at 2100 psi was used to drill a well. The maximum pump pressure was 2500 psi and with an 8.5 PPG drilling fluid the bit nozzle pressure loss was calculated to be about 1586 psi at 5000 feet. At 5020 feet a salt water injection zone was encountered which required an increase in drilling fluid density to 13.0 PPG. The rupture disc was opened by maintaining the original flow rate of 530 GPM. This allowed fluid to flow through the closed size 18 nozzle plus the existing 12, 13 and 13 sized nozzles resulting in an optimized hydraulic system with a 13.0 PPG drilling fluid, a flow rate of 530 GPM, and a bit pressure loss of 871 psi, without having to remove the drill bit from the well in order to make the nozzle changes on the surface.

The ability to increase or decrease the total flow area of the drill bit is important since an optimized hydraulic system can improve the drilling rate, reduce equipment inefficiencies and lower drilling costs. The present invention allows the bit total flow area to be easily and quickly adjusted concurrently with drilling.

It should be understood that there can be improvements and modifications made to the embodiments of the invention described in detail above without departing from the spirit or scope of the invention, as set forth in the accompanying drawings.

What is claimed is:

1. A method for determining the effect of total flow area at a bit on drilling penetration rate, comprising the steps of:

(a) mounting a plurality of nozzles in a drill bit, at least one nozzle being open and at least one nozzle having closure means adapted to open at a selected value of differential pressure across the bit and being in an initially closed state;

(b) placing the bit in a well on drill pipe and commencing drilling;

(c) drilling while measuring drilling penetration rate at a known pressure for a time sufficient to collect data;

(d) increasing the differential pressure across the bit to a value of differential pressure such as to open the initially closed nozzle to increase total flow area at the bit;

(e) drilling while measuring drilling penetration rate at a known pressure as in step (c) for a time sufficient to collect required data at the adjusted flow area at the bit; and (f) comparing the drilling penetration rates measured in step (c) and step (e).

2. The method of claim 1 wherein before step (d) the initially open nozzle is closed, the initially open nozzle having a total flow area greater than the initially closed nozzle.

* * * * *